US007389956B2

(12) United States Patent
Hung

(10) Patent No.: US 7,389,956 B2
(45) Date of Patent: Jun. 24, 2008

(54) REEL DEVICE FOR BLIND

(76) Inventor: Hans Hung, No. 32, Lane 670, Sec. 1, Jhangshuei Road, Sihu Township, Changhua County (TW)

( * ) Notice: Subject to any disclaimer, the term of this patent is extended or adjusted under 35 U.S.C. 154(b) by 308 days.

(21) Appl. No.: 11/260,401

(22) Filed: Oct. 28, 2005

(65) Prior Publication Data

US 2007/0095966 A1 May 3, 2007

(51) Int. Cl.
*B65H 57/00* (2006.01)

(52) U.S. Cl. ..... 242/397; 160/170

(58) Field of Classification Search ..... 242/377, 242/397, 615, 407, 614, 613.1, 365, 365.3, 242/365.2; 160/84.01, 84.04, 84.05, 84.06, 160/170, 171

See application file for complete search history.

(56) References Cited

U.S. PATENT DOCUMENTS 4,623,012 A * 11/1986 Rude et al. ..... 160/243
6,915,831 B2 * 7/2005 Anderson ..... 160/173 R
7,210,646 B2 * 5/2007 Hsu ..... 242/397
2003/0178155 A1 * 9/2003 Fraczek ..... 160/170
2006/0237571 A1 * 10/2006 Hsu ..... 242/377

* cited by examiner

*Primary Examiner*—Peter M. Cuomo
*Assistant Examiner*—William E Dondero
(74) *Attorney, Agent, or Firm*—Rosenberg, Klein & Lee

(57) ABSTRACT

A reel device includes a reel rotatably supported in a casing of a blind. A guide is mounted on an end of the reel. The guide includes an abutting point against which a cord of the blind abuts. The guide further includes an extension extending toward the other end of the reel. A line passing the abutting point and an end edge of the guide is at an acute angle with a line orthogonal to a longitudinal axis of the reel. When a section of the cord reaches the abutting point and the end edge of the guide, an acute angle is created, and this acute angle of the section of the cord avoids two forces that act on the cord in opposite direction from acting on the same line. Thus, overlapping of the turns of the cord on the reel is avoided.

2 Claims, 7 Drawing Sheets

REEL DEVICE FOR BLIND

BACKGROUND OF THE INVENTION

1. Field of the Invention

The present invention relates to a reel device. More specifically, the present invention relates to a reel device for a blind.

2. Description of the Related Art

Blinds provide a decoration effect while shielding people from the sunlight. A typical blind generally comprises two suspension cords each having a first end fixed to a winding reel and a second end fixed to the blind.

FIG. 1 of the drawings illustrates a conventional device 1 for evenly winding or unwinding a suspension cord 16 of a blind. FIG. 1A is an enlarged view of a circled portion in FIG. 1. FIG. 2 is a partial sectional view of the device in FIG. 1.

The device 1 comprises a reel 11 and a casing 12 for rotatably supporting the reel 11. An end of the suspension cord 16 extends through a hole (not shown) in a bottom wall 121 of the casing 12 and another hole 13 (FIG. 1A), and is then guided by a guide 14 that provides a wall 141 against which the suspension cord 16 abuts.

However, as shown in FIG. 1A, a gap D exists between an inner side of the guide 14 and the reel 11 such that the suspension cord 16 is apt to slip away via the gap D in a case that the suspension cord 16 has a small diameter or a relatively large force is applied to the suspension cord 16.

FIG. 3 is a partial sectional view of another conventional device modified from the device in FIG. 1. In this device, the reel 15 includes a conical section for smoothly guiding the suspension cord 16, yet the above-mentioned problem still exists. U.S. Pat. No. 5,328,113 discloses a similar design and thus has the same disadvantage.

SUMMARY OF THE INVENTION

A reel device in accordance with the present invention comprises a reel adapted to be rotatably supported in a casing of a blind. The reel includes a first end and a second end. A guide is mounted on the first end of the reel. The guide comprises an abutting point adapted to be abutted against by a cord of the blind. The guide further comprises an extension extending toward the second end of the reel. The extension includes an end edge. A line passing the abutting point and the end edge is at an acute angle with a line orthogonal to a longitudinal axis of the reel.

Preferably, the guide is removably mounted on the reel.

The reel device in accordance with the present invention is simple in structure. Further, when a section of the cord reaches the abutting point and the end edge of the guide, an acute angle is created, and this acute angle of the section of the cord avoids two forces that act on the cord in opposite direction from acting on the same line. Thus, overlapping of the turns of the cord on the reel is avoided.

Other objectives, advantages, and novel features of the invention will become more apparent from the following detailed description when taken in conjunction with the accompanying drawings.

DETAILED DESCRIPTION OF THE PREFERRED EMBODIMENTS

Figures 1, 1A:
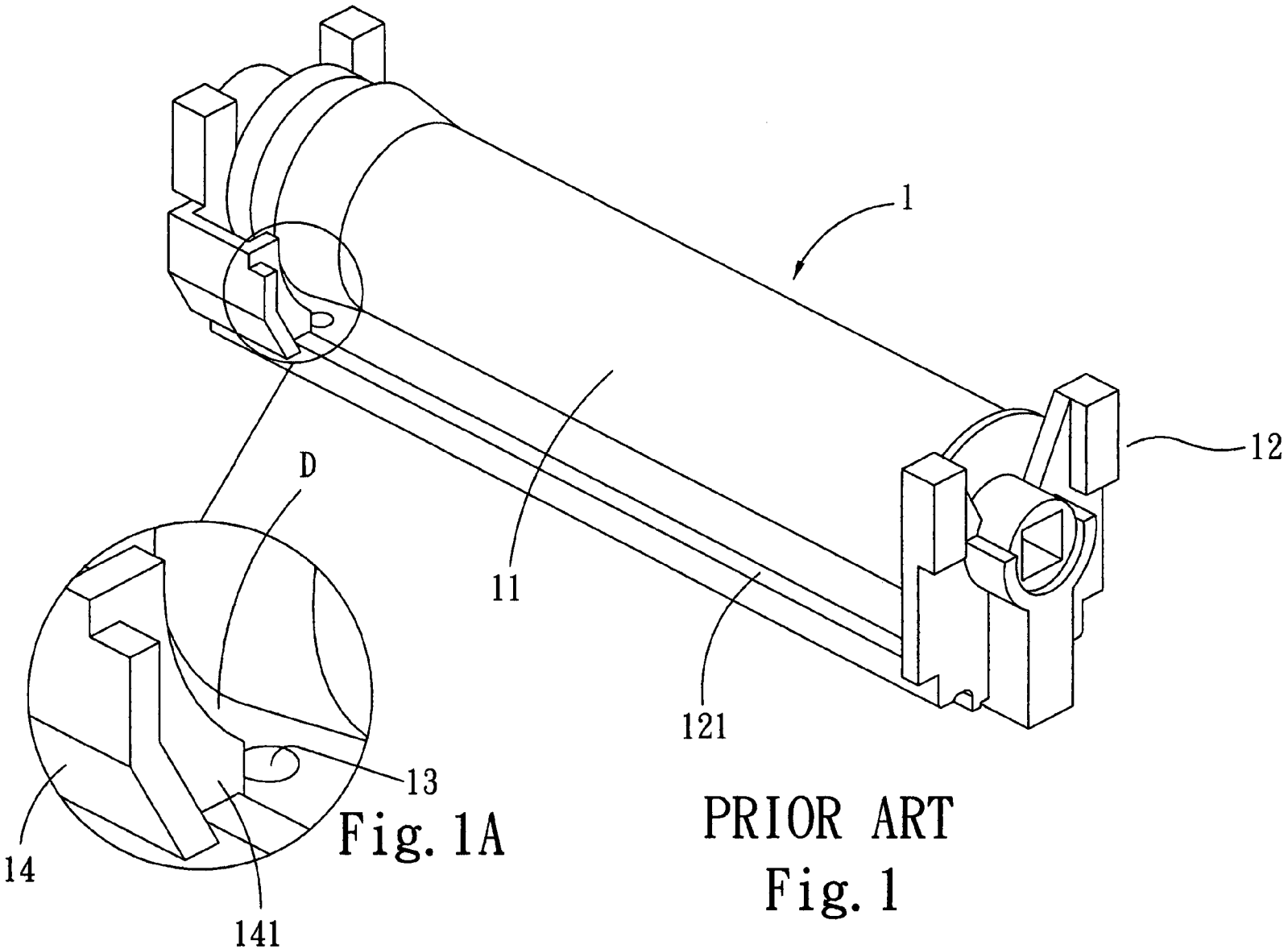
PRIOR ART Fig. 1
FIG. 1 is a perspective view of a conventional device for winding/unwinding a suspension cord of a blind.
FIG. 1A is an enlarged view of a circled portion in FIG. 1.
Figure 2:
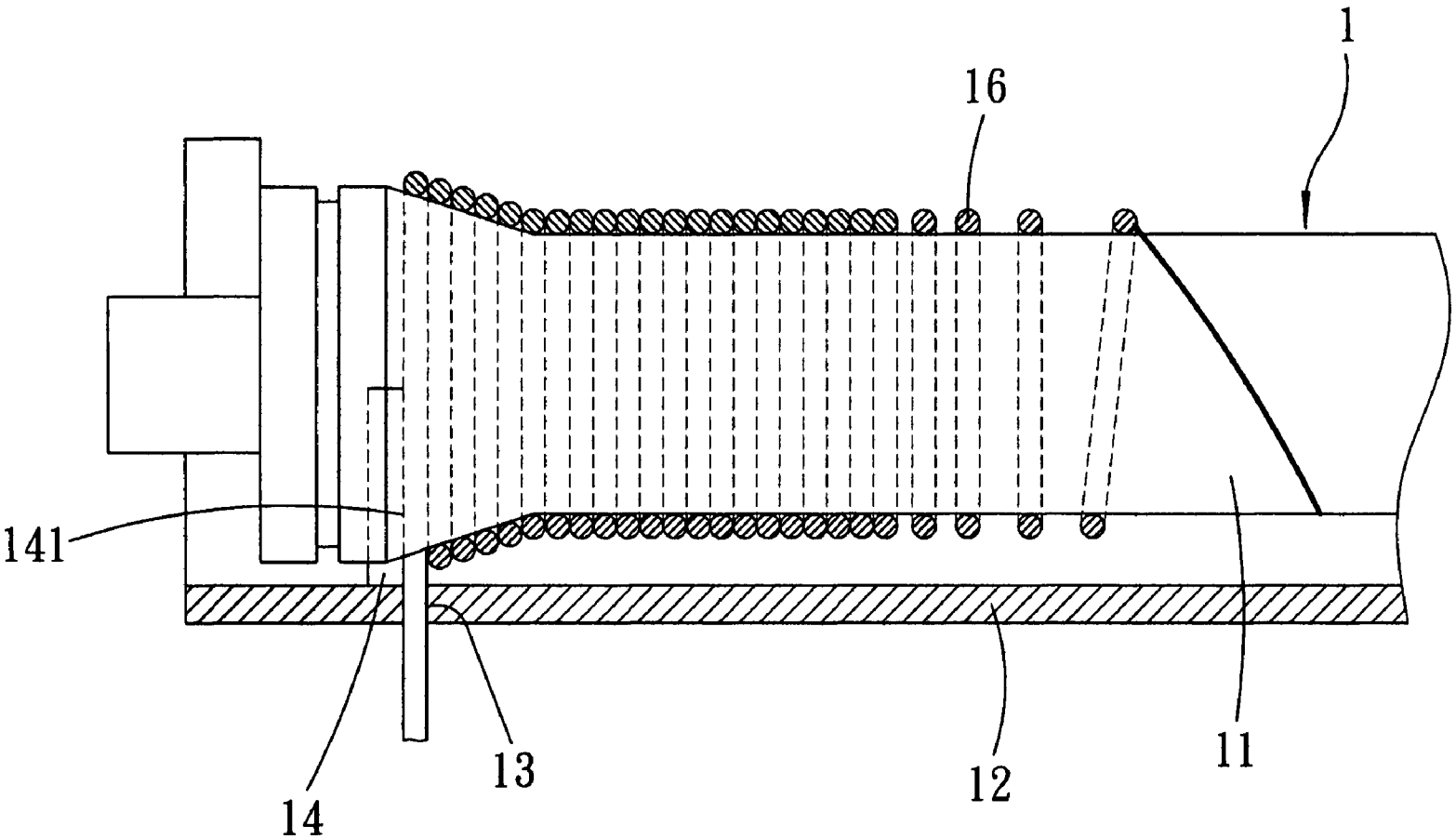
PRIOR ART Fig. 2
FIG. 2 is a partial sectional view of the device in FIG. 1.
Figure 3:
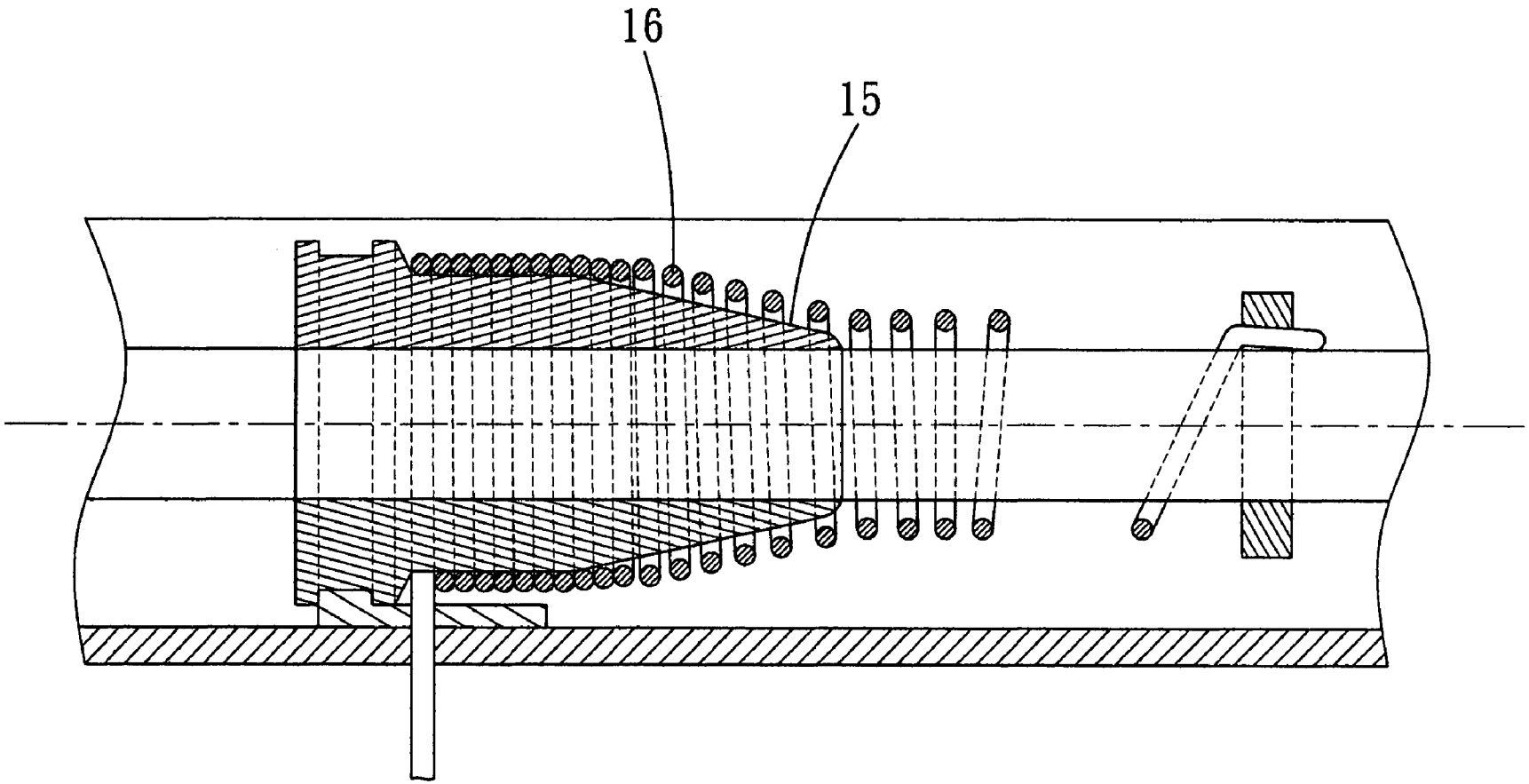
PRIOR ART Fig. 3
FIG. 3 is a partial sectional view of another conventional device for winding/unwinding a suspension cord of a blind.
Figure 4:
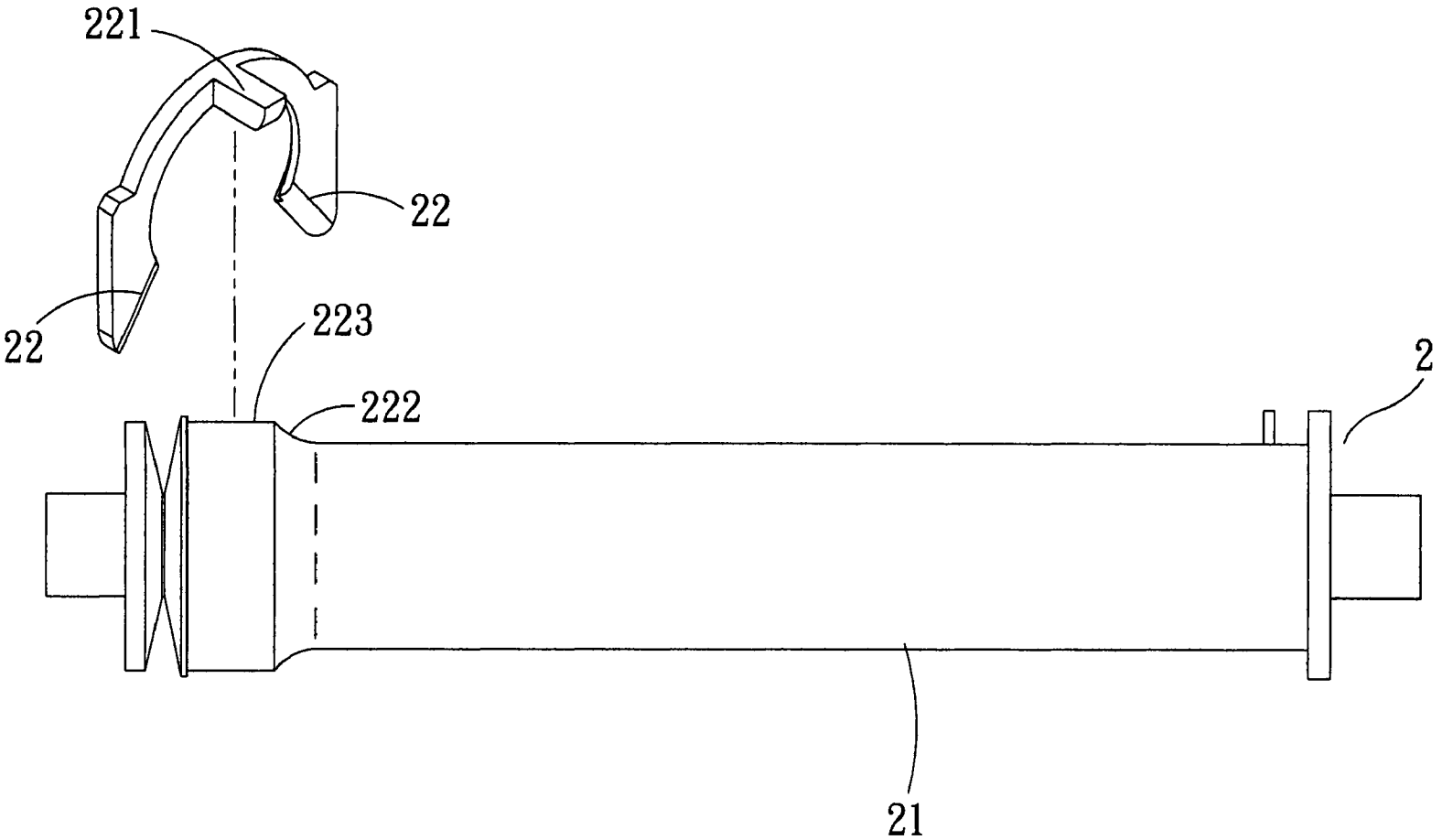
FIG. 4 is an exploded perspective view of a reel device for a blind in accordance with the present invention.

Referring to FIG. 4, a reel device 2 for a blind in accordance with the present invention comprises a reel 21 and a guide 22 mounted on the reel 21. The reel 21 is rotatably supported in a casing 3 (see FIG. 7) or the like. In this embodiment, the guide 22 is mounted on an end 223 (the left one in FIG. 4) of the reel 21.

Figure 7:
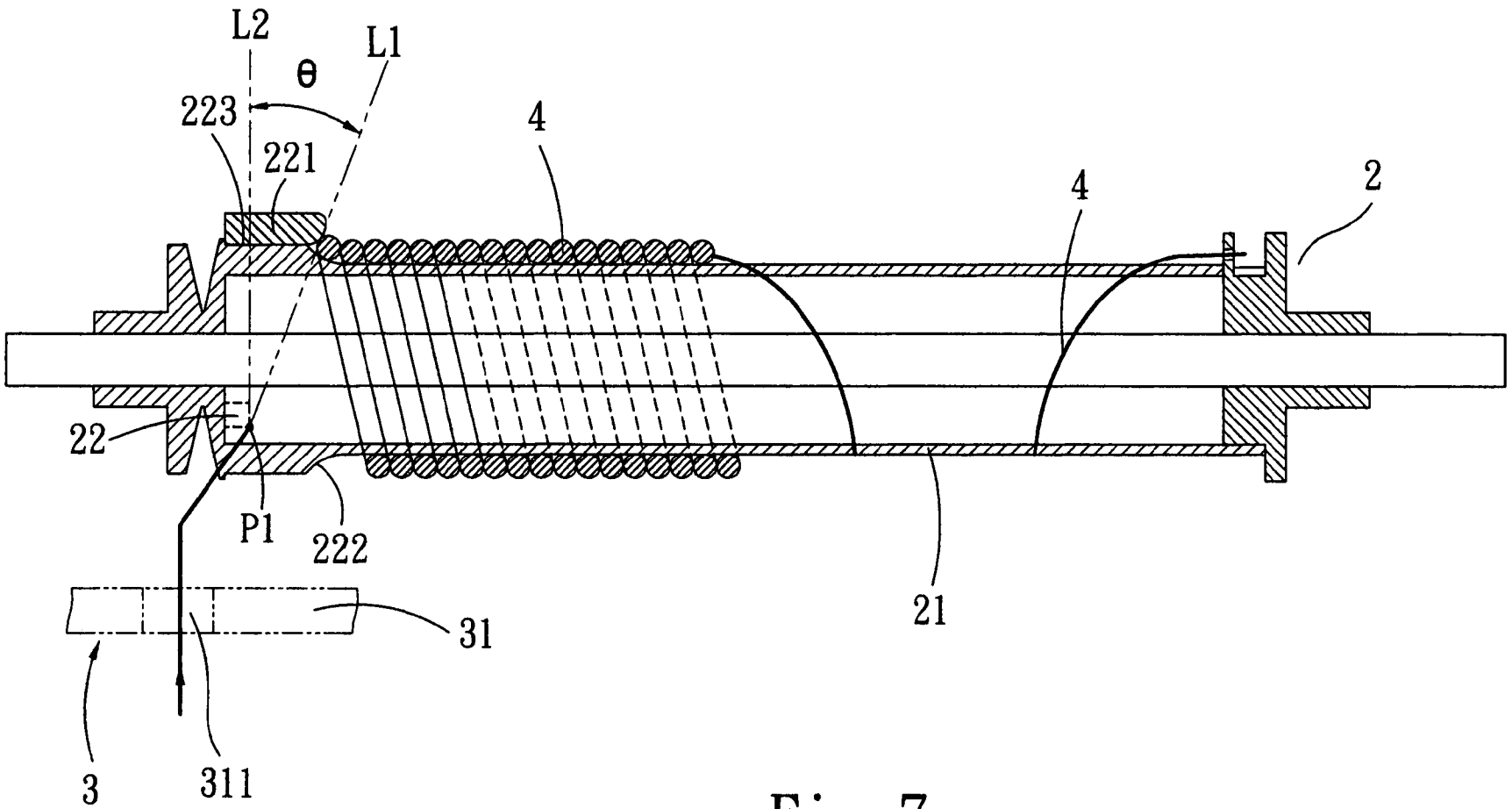
FIG. 7 is a view similar to FIG. 6, showing insertion of the cord through a casing for the reel.

An end of a cord 4 extends through a hole 311 (FIG. 7) of the casing 3 and then along the guide 22. As illustrated in FIG. 7, the cord 4 abuts against the guide 22 at a point P1 (hereinafter referred to as "abutting point").

Figure 5:
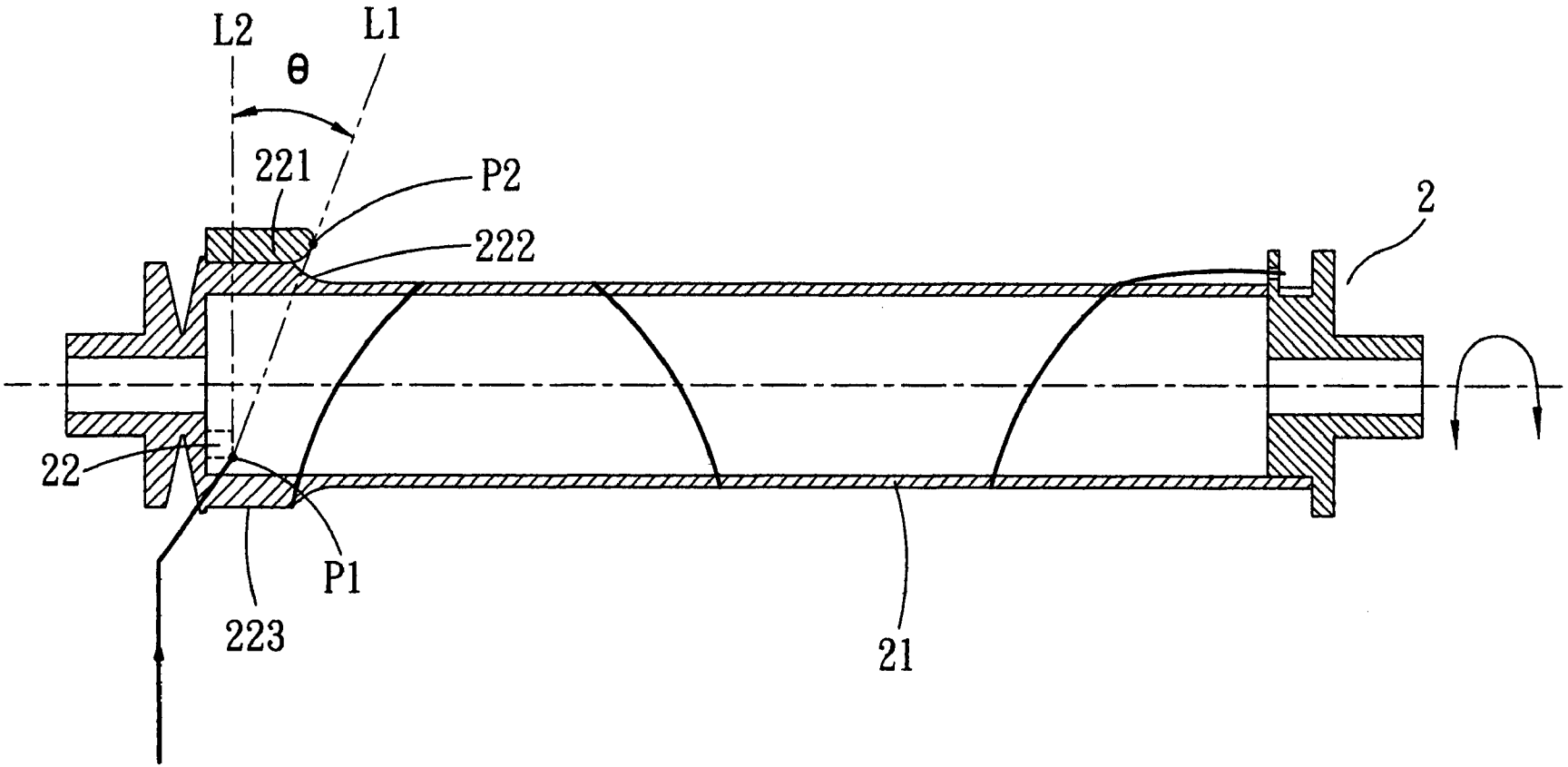
FIG. 5 is a sectional view of the reel device in accordance with the present invention at the beginning of the winding operation.
Figure 6:
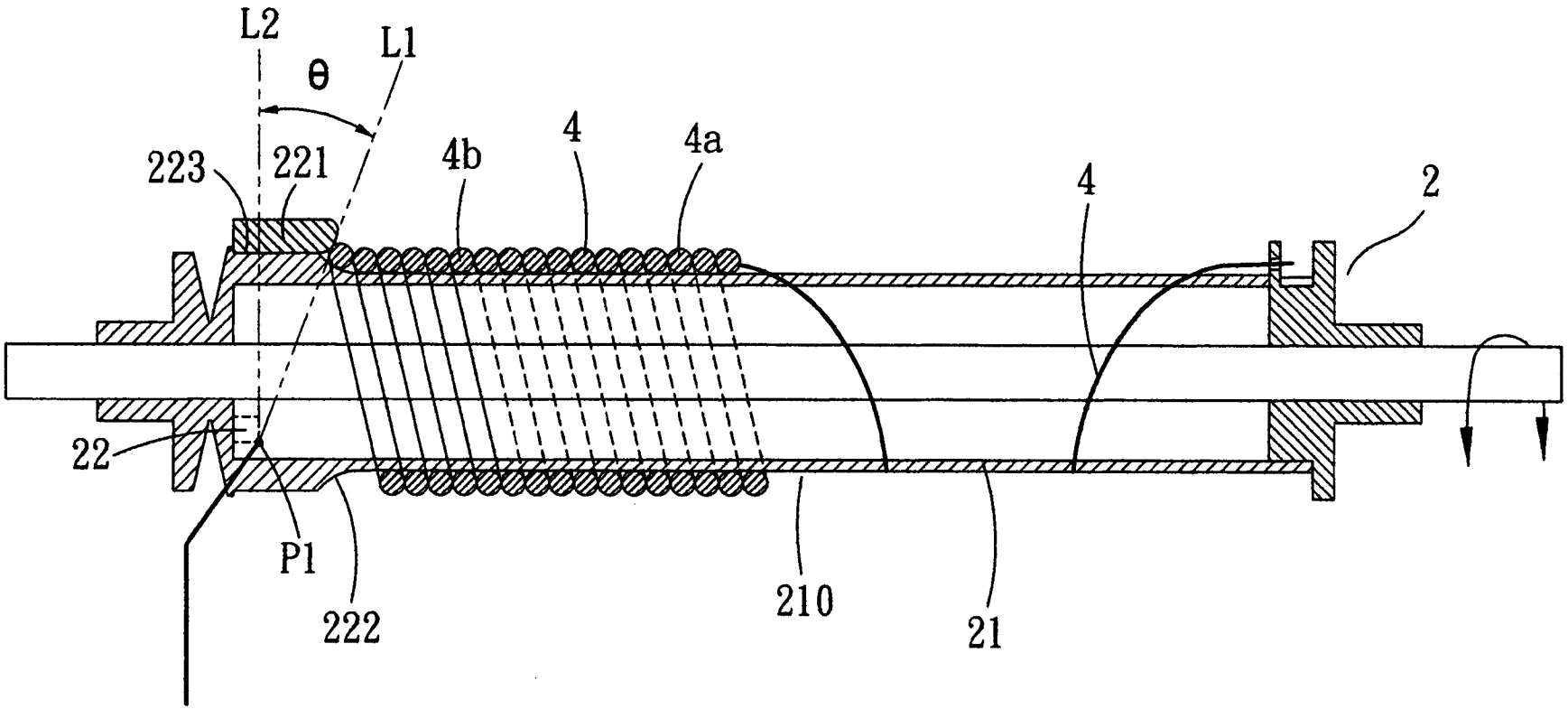
FIG. 6 is a sectional view of the reel device after several revolution of the reel.

Referring to FIG. 4, the guide 22 comprises an extension 221 extending toward the other end of the reel 21. As illustrated in FIGS. 5 and 6, the extension 221 includes an end edge P2 facing the other end of the reel 21. A line L1 passing through the abutting point P1 and the end edge P2 of the extension 221 is at an acute angle θ with a line L2 orthogonal to a longitudinal axis of the reel 21.

When the reel 21 turns in either direction (clockwise or counterclockwise, see the arrow in FIG. 5), the cord 4 is subject two forces in opposite directions when wound around the reel 21. One of the forces is the gravitational force acting on the weight of the blind, and the other is the pulling force by the user. When a section of the cord 4 reaches the abutting point P1 and the end edge P2 of the guide 22, an acute angle θ is created, and this acute angle θ of the section of the cord 4 avoids the two forces from acting on the same line. Thus, overlapping of the turns of the cord 4 on the reel 21 is avoided.

Preferably, the end 223 of the reel 21 includes an inwardly tapering arcuate section 222. Referring to FIG. 6, when the cord 4 is wound around the reel 21, inner turns 4*a* of the cord 4 are loose whereas successive turns 4*b* of the cord 4 are tense due to provision of the inwardly tapering arcuate section 222. Thus, the turns 4*b* of the cord 4 are apt to slide inward toward the other end of the reel 21 without the risk of jamming on the end 223 of the reel 21. In a case that the pulling force is increased for pulling a heavier cord for a heavier blind, the cord 4 can be loosened from the reduced section 210 of the reel 21, reducing the resistance and allowing smooth winding/unwinding of the cord 4.

The reel device 2 in accordance with the present invention is simple in structure and the guide 22 can be removably mounted on the reel 21. Further, the guide 22 may be used with a reel of the type without any conical section or similar arrangement on the end 22 of the reel 21.

Although specific embodiments have been illustrated and described, numerous modifications and variations are still possible without departing from the essence of the invention. The scope of the invention is limited by the accompanying claims.

What is claimed is:

1. A reel device for a blind, the reel device comprising:

a reel adapted to be rotatably supported in a casing of a blind, the reel including a first end, a second end, and an inwardly tapering arcuate section adjacent the first end; and a guide mounted on the first end of the reel, the guide including an abutting point adapted to be abutted against by a cord of the blind, the guide further including an extension extending toward the second end of the reel and having a surface thereof being contiguous with a corresponding surface of the first end, the extension including an end edge overhanging the tapering arcuate section, a line passing the abutting point and the end edge being at an acute angle with a line orthogonal to a longitudinal axis of the reel.

2. The reel device for a blind as claimed in claim 1 wherein the guide is removably mounted on the reel.

* * * * *